US006782645B2

(12) United States Patent
Hickle et al.

(10) Patent No.: US 6,782,645 B2
(45) Date of Patent: Aug. 31, 2004

(54) SAFETY GUARD AND DEACTIVATION DEVICE

(75) Inventors: Ernest J. Hickle, New Market, TN (US); Gregory Wilson, Whitesburg, TN (US)

(73) Assignee: Forenta, L.P., Morristown, TN (US)

( * ) Notice: Subject to any disclaimer, the term of this patent is extended or adjusted under 35 U.S.C. 154(b) by 311 days.

(21) Appl. No.: 10/167,373

(22) Filed: Jun. 11, 2002

(65) Prior Publication Data

US 2003/0226294 A1 Dec. 11, 2003

(51) Int. Cl.[7] ..... D06F 71/32
(52) U.S. Cl. ..... 38/63; 38/37
(58) Field of Search ..... 38/63, 27, 36, 38/37, 40, 43, 1 D, 17; 137/565.13, 906, 7; 192/116.5, 129 R, 130–133, 137, 129 B

(56) References Cited

U.S. PATENT DOCUMENTS 2,050,619 A * 8/1936 Malott, Jr. ..... 192/133
2,369,243 A 2/1945 Lechler
2,395,780 A 2/1946 Devol, Jr. et al.
3,333,355 A * 8/1967 Tucker ..... 38/27
3,640,007 A * 2/1972 Richterkessing ..... 38/41
4,520,637 A * 6/1985 Fleissner ..... 68/5 D
5,067,519 A * 11/1991 Russell et al. ..... 137/596.14
6,725,585 B2 * 4/2004 Hickle et al. ..... 38/40

* cited by examiner

*Primary Examiner*—Ismael Izaguirre
(74) *Attorney, Agent, or Firm*—Pitts & Brittian, P.C.

(57) ABSTRACT

A safety guard system and deactivation device for protection of an operator of a garment press. A guard bar is manipulated in concert with movement of a press head between operative and inoperative positions. Manipulation of the guard bar reciprocates an activation device for sequentially activating actuatable valves which control the transmission of pressurized air to a head closing piston and cylinder for press head movement. A deactivation device is positioned proximal to the activation device to control reciprocation thereof. The deactivation device is retracted when pressurized air is interrupted to the garment press, resulting in restraint of activation device and deactivation of the actuatable valves, along with movement of the press head and guard bar to an inoperative position. When pressurized air is renewed to the garment press, the deactivation device is extended allowing for reciprocation of the activation device and activation of the actuatable valves, along with movement of the press head and guard bar from an inoperative position to an operative position upon manipulation of the guard bar.

16 Claims, 7 Drawing Sheets

SAFETY GUARD AND DEACTIVATION DEVICE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates to a system for operating a garment finishing press powered by pneumatic power. More particularly, this invention relates to a safety guard and a deactivation device for protecting an operator of a garment finishing press having a press head powered by pneumatic power.

2. Description of the Related Art

Numerous types of garment finishing press machines have been provided for the purpose of ironing and pressing textile materials and garments. These machines are typically powered by pressurized air and include a press head which closes in a scissors-like motion against a fixed pressing surface, known as the buck. Once closed, the machines may apply heat and/or pressure to press and dry the materials undergoing pressing operations. Typical of these modern machines is a power driven "scissors" style press machine which employs a pneumatic closing mechanism. When activated, the closing mechanism lowers the press head until it registers against the press buck.

Due to the danger these power driven machines pose to an operator who catches a hand or a body part between the press head and the buck, safety standards have been developed requiring the operator to simultaneously manipulate two activators separated by a distance great enough to require the use of both hands in order to effectuate the closing of the press head, and/or the use of a peripheral safety bar that an operator may manipulate to open or close the press head in relation to the buck. The safety standards are formalized in a standard published by the American National Standards Institute (ANSI) for Commercial Laundry and Drycleaning Operations (ANSI Z8.1-1996, Section 4.4.2.1).

A conventional garment finishing press may require the operator to press and hold mechanical actuators such as a button or handle, which activates a pneumatic power source controlled by valves that are electrically or pneumatically operated for lowering the press head until engagement of the buck in a closed position. Should the close button be released, the press head returns to the open position. Alternatively, a conventional garment finishing press may include additional hand controls that must be manipulated by the operator to hold the press head in a closed position and to release the press head for opening. Prior art devices for closure and locking of a garment finishing press are disclosed in U.S. Pat. No. 2,395,780, issued to Devol, Jr., et al. on Feb. 26, 1946, and U.S. Pat. No. 2,369,243, issued to Lechler on Feb. 13, 1945.

A safety guard and deactivation device is needed to protect a person from injury during startup and shutdown of a garment finishing press machine. An improved safety guard and deactivation device is needed to protect a person operating the press during and after interruptions in the supply of pressurized air to a pressing head of a garment finishing press machine.

BRIEF SUMMARY OF THE INVENTION

In accordance with the present invention, there is provided a safety guard and deactivation device for protection of an operator during operation of a garment finishing press having an operator controlled mechanism for movement of a press head between operative and inoperative positions. The safety guard includes a guard bar manipulated by a person in concert with movement of a press head between operative and inoperative positions. The guard bar is mechanically connected by a plurality of pivoting connectors to an activation device that is reciprocated to manipulate at least one actuatable valve that regulates the supply of pneumatic fluid flow from a source of pneumatic power provided to a means for movement utilized to move the press head. The reciprocating movement of the activation device is responsive to the movement of the press head and the guard bar manipulated by the operator between an operative and inoperative position.

An operation reset system includes a deactivation device for protecting the operator during startup, shutdown, and/or upon interruption of pneumatic fluid flow to the garment finishing press. The deactivation device includes a piston means having a piston rod and means affixed to a distal end of the piston rod for selective engagement of the activation device. At least one spring means is connected between a base of the piston means and the means affixed to the distal end of the piston rod, with the spring means biased to return the distal end of the piston rod to a retracted position. The piston means is maintained in communication with the pneumatic fluid flow of the garment finishing press by valve means whereby pressure in the piston means is lost when pneumatic fluid flow is interrupted to the garment finishing press. The means affixed to a distal end of the piston rod retracts and provides for selective engagement of the activation device when pneumatic fluid flow is interrupted to the garment finishing press. The retraction of the distal end prevents the activation device from reciprocating and inactivates the transfer of pneumatic fluid flow by the at least one actuatable valve until air pressure is restored to the garment finishing press which resets the deactivation device. With the at least one actuator valve inactivated, the press head is prevented from moving from an inoperative position until air pressure is restored to the garment finishing press.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
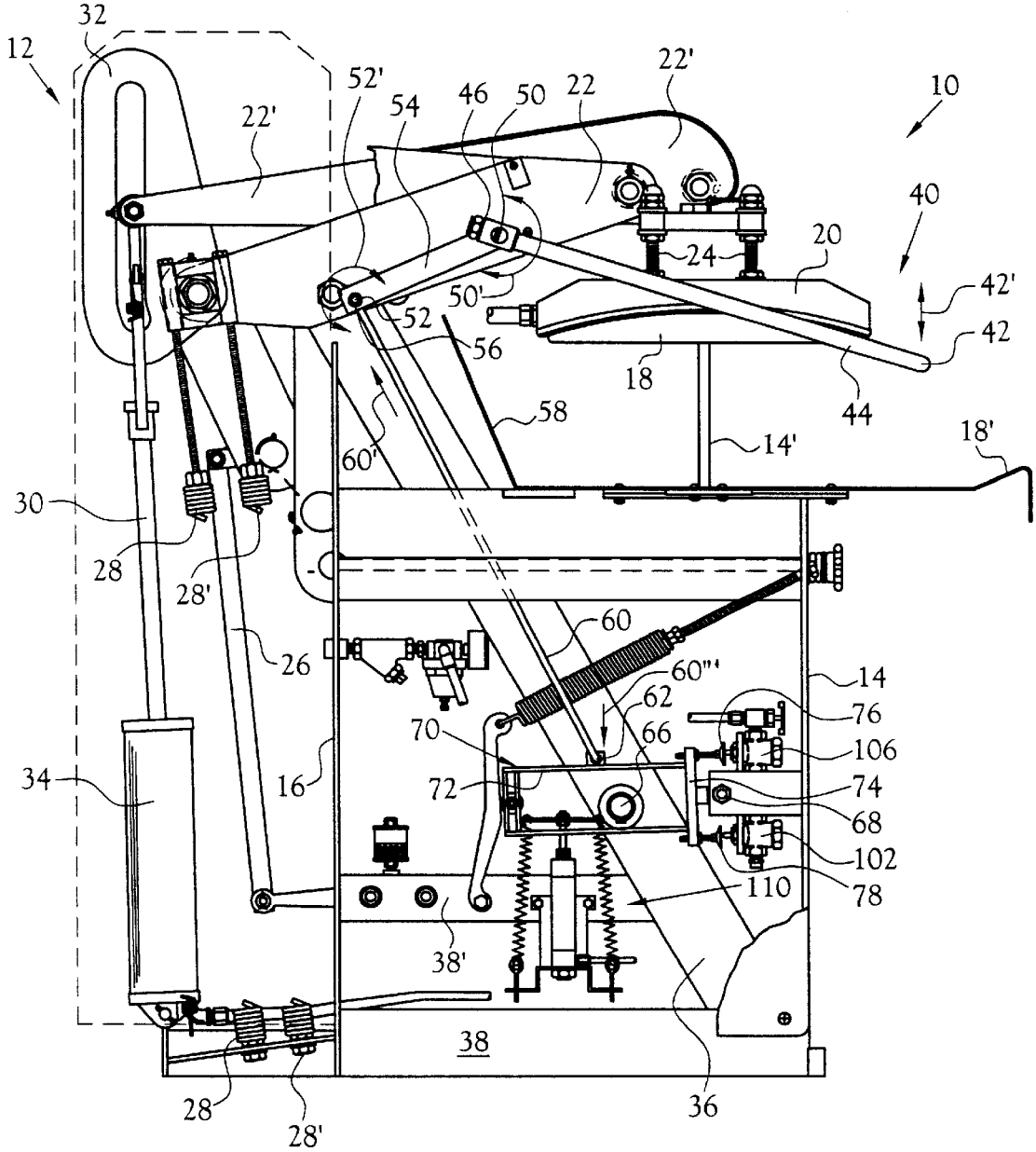
FIG. 1 is a side view of a garment finishing press including an operator manipulated safety guard bar, connecting members, an activation device and one embodiment of a deactivation device of the present invention.

A safety guard and deactivation device 10 for control of a garment finishing press 12 is illustrated generally in FIG. 1. One embodiment of the safety guard and deactivation device 10 includes an operating guard control device 40 connected by a plurality of connectors to an activation device 70 disposed to activate a valve means 102, 106 in pneumatic fluid flow communication with a source of pneumatic power. A deactivation device 110 is positioned proximal to the activation device 70 (see FIGS. 1, 2A, 2B, 2C) for control of the activation device and valve means 102, 106 upon interruption of pneumatic fluid flow to the garment finishing press 12. The safety guard and deactivation device 10 provides protection for a person operating a garment finishing press 12 utilizing a source of pneumatic power provided by a pneumatic fluid flow transfer system such as a pressurized air system (not shown). A typical garment finishing press 12 known to those skilled in the art may include a "scissors" style press, having at least one front support member 14 supporting a pressing buck 18, and at least one rear support member 16 providing a support frame for a suspended pressure plate and support lever arm 22, and a pressure lever 22'. The pressing buck 18 may be supported above a front support member 14 by a support member 14'. A buck guard work table 18' may be attached to an upper portion of the support frame 14 as a safety measure to force an operator to stand a selected distance away from the pressing buck 18. An additional buck guard work surface 58 may be attached behind the pressing buck 18 as a safety measure to protect an operator if required to reach behind the pressing buck 18. In one embodiment, one suspended pressure plate and support lever arm 22 is connected by connector bracket 24 to a press head 20 that is supported above the pressing buck 18. The suspended pressure plate and support lever arm 22 is supported by spring pairs 28, 28' having springs and support rods (see FIG. 1). A shock absorbing connector 26 is located proximal to spring pairs 28, 28' and is connected between rear support member 16 and support lever arm 22. The pressure lever 22' is pivotably supported by pressure cam 32 and means for movement including at least one piston rod 30 extendable by at least one head closing piston and cylinder 34. The means for movement is powered by a source of pneumatic power providing pressurized air transmitted by pneumatic fluid lines for extension and retraction of piston rod 30 from the at least one head closing piston and cylinder 34 attachable at the rear portion of the pressure lever 22', for movement of the connector bracket 24 attached to the press head 20. The means for movement, lever arm 22 and pressure lever 22' are further supported by rear support member 16, angled support member 36, a pair of lower support members 38, 38', and front support member 14 that provide a base and support the activation device 70 (see FIGS. 1, 2A, 2B, 2C). The front support member 14 is utilized to support a first end 74 of the activation device 70, and a valve means including at least one actuator valve 102, 106, and pivoting connection 68 for the activation device 70 (see FIG. 1).

Figure 5:
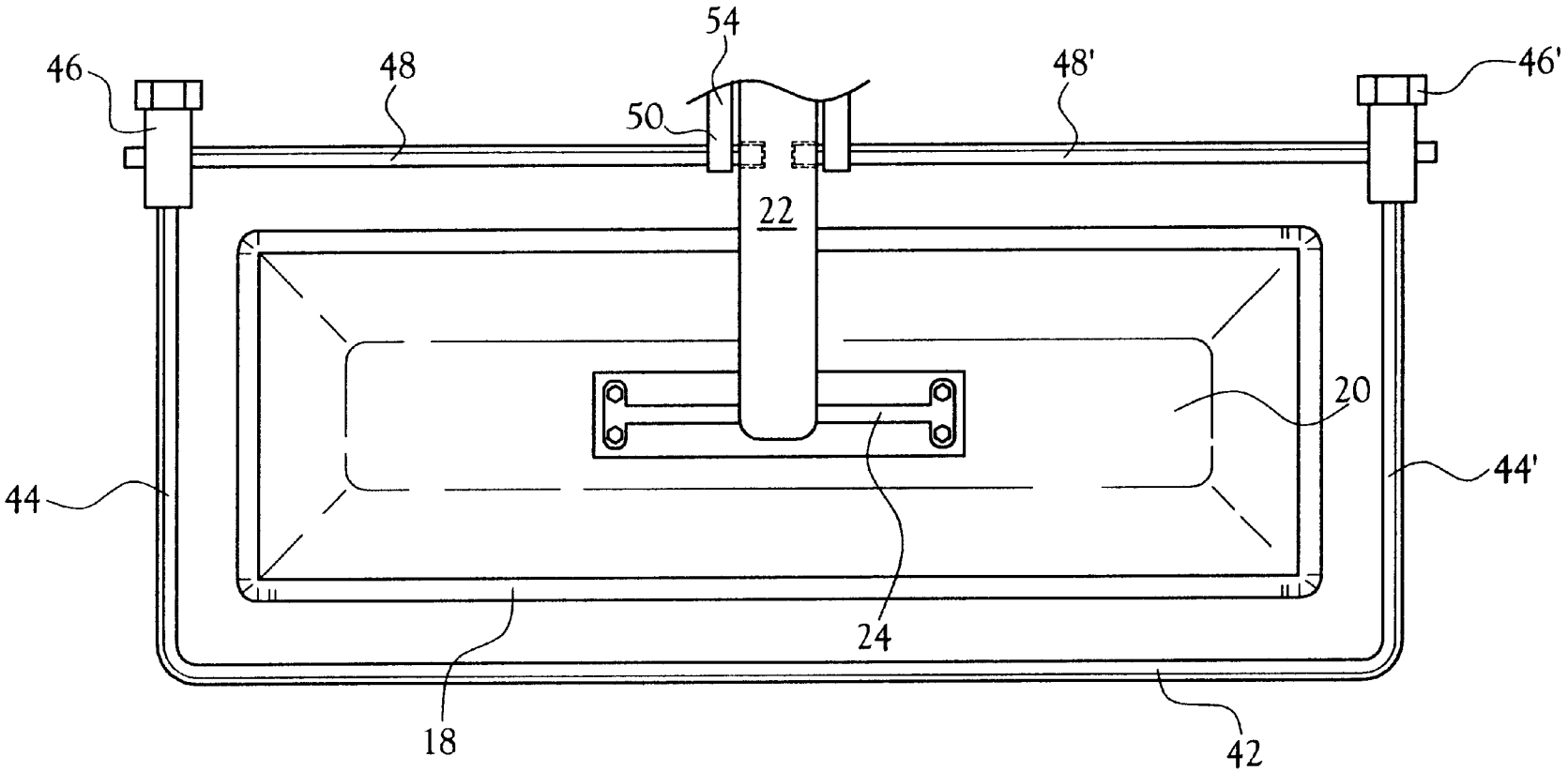
FIG. 5 is a top view of FIG. 1, illustrating the safety guard bar oriented to encircle a press head of a garment finishing press.

In one embodiment of the safety guard system 10, an operating guard control device 40 is positioned to encircle the press head 20 (see FIGS. 1 and 5). The control device 40 is manipulated by an operator to control movement of the press head 20 and to provide a means for manipulating the press head 20 between an inoperative, open position above the pressing buck 18, to an operative, closed position against the pressing buck 18. The operating guard control device 40 includes a safety guard bar 42 that is manipulated by an operator to actuate the safety guard system 10. The guard bar 42 encircles at a spaced distance from the front and respective first and second side portions of the outer perimeter of the press head 20 (see FIGS. 1 and 5). The front portion of the guard bar 42 is angled downwards from the plane formed by the perimeter of the press head 20, to provide protection for an operator's hands from being caught in the press head 20 encircled by the guard bar 42 as the press head 20 is closed against the pressing buck 18 (see FIG. 1). The guard bar 42 includes side arms 44, 44', and at least one connector 46 attached by a connector segment 48 having an end disposed to connect to a first pivot 50. A second connector 46' may be included for attachment between second side arm 44' and second connector segment 48' having an interior end attached to pivot in concert with first pivot 50 disposed proximal to suspended pressure plate and support lever arm 22 (see FIGS. 1 and 5). The guard bar 42 is configured to allow an operator to manipulate the bar while standing in front of, or to either side of the press head 20. The guard bar 42 is pivotably connected to the suspended pressure plate and support lever arm 22 supporting the press head 20. When the safety guard bar 42 is manipulated by an operator, and pneumatic fluid such as pressurized air is supplied to the finishing press 12, the guard bar 42 and the press head 20 are raised and lowered in unison.

An operator responsive mechanism responsive to the movement of the press head 20 between operative and inoperative positions includes a means for connecting that is interposed to connect between the guard bar 42 and a valve means including at least one actuated valve, and preferably two independently actuator valves 102, 106 providing control of movement of the press head 20. The operator responsive mechanism and means for connecting includes pivot connections associated with movement of the guard bar 42 in advance of the downwardly movement of the press head 20, and includes a plurality of connector members moved in response to an operator's movement upwards 42' or downwards 42" of the guard bar 42 (see FIG. 1). The pivot connections of the connecting members include at least one connector bar 48 (see FIG. 5) connected to a first pivot 50 (see FIG. 1) disposed in a pivoting connection on approximately a middle portion of the suspended pressure plate and lever arm 22. As the safety guard bar 42 is manipulated upwards to an open position by an operator, the connector bar 48 and the first pivot 50 rotate in a counter-clockwise direction 50' as illustrated in FIG. 1. The means for connecting includes a connector member 54 disposed between, and attached to, first pivot 50 and second pivot 52. When safety guard bar 42 is manipulated upwards, first pivot 50 rotates and a trailing end 56 of connector member 54 is rotated downwards to force second pivot 52 to rotate 52' in a counterclockwise direction with resulting moving of means for connecting such as a connecting rod 60 downwards with movement of the activation device 70 downwards. When safety guard bar 42 is manipulated downwards, trailing end 56 is rotated upwards and second pivot 52 is rotated 52' in a clockwise direction, and the connector rod 60 linked at an upper end to second pivot 52 is moved 60' upwards, moving the activation device 70 upwards. The connector rod 60 is connected at a lower end to a connector joint 62 that is pivotably joined to an upper side of a substantially rectangular, or "A" shaped frame 72 of the activation device 70 (see FIGS. 1, 2A, 2B, 2C).

The frame 72 is supported at a first end 74 by a pivoting connection 68 to a front support 14, to allow pivoting of the first end 74. The first end 74 includes an upper valve actuator 76 and a lower valve actuator 78. A second end 80, also referred to as the reciprocating end 80, is supported in a cantilevered orientation in reference to the first end 74, to allow the reciprocating end 80 to be repetitively repositioned between a raised position (see FIG. 2A), and a lowered position (see FIG. 2B). The frame 72 includes an interior opening into which a stop member 66 protrudes, with the stop member 66 stopping the frame 72 from pivoting downwards past the lowered position, or from pivoting upwards past the raised position. The reciprocating end 80 is moved repetitively in an upwards 80' motion (see FIG. 2A), and in a downwards 80" motion (see FIG. 2B) as the connector rod 60 is moved 60', and the connector joint 62 is displaced 60"' either downwards or upwards by movement of the safety guard bar 42 by the operator (see FIG. 1). The reciprocating end 80 includes a slot 82 through which an adjustment connector 84 is fixed against an outer side of slot 82, with the adjustment connector 84 attached to a roller 86 positioned on an interior side of slot 82. As reciprocating end 80 is moved upwards 80' to a raised position (see FIG. 2A), and is reciprocated downwards 80" to a lower position (see FIG. 2B), the roller 86 is rotated against a curved side 94 of a lever 88. Lever 88 is pivotably connected at a pivot end 92 to the lower support frame member 38'. The curved side 94 includes a curved, or an angled, mid-portion 96 against which the roller 86 is rotated as reciprocating end 80 is moved as the operator manipulates the safety guard bar 42. Lever 88 includes a free end 98 having a spring 100 connected thereto, for repositioning of spring end 98 to a substantially upright position. Free end 98 moves in a generally lateral motion 98' created by the rotation of roller 86 against curved mid-portion 96, during each up/down movement of reciprocating end 80 of frame 72. The interaction of the roller 86 against the curved side 94 of lever 88, having the curved mid-portion 96 thereon, in combination with the tension maintained by spring 100 of lever 88 against roller 86, provides a control means for maintaining the frame 72, rod 60, member 54 and guard bar 42 in a fixed position, either up or down, until an operator manipulates the guard bar 42 and press head 20 to overcome the spring tension of the control means.

Figure 2A:
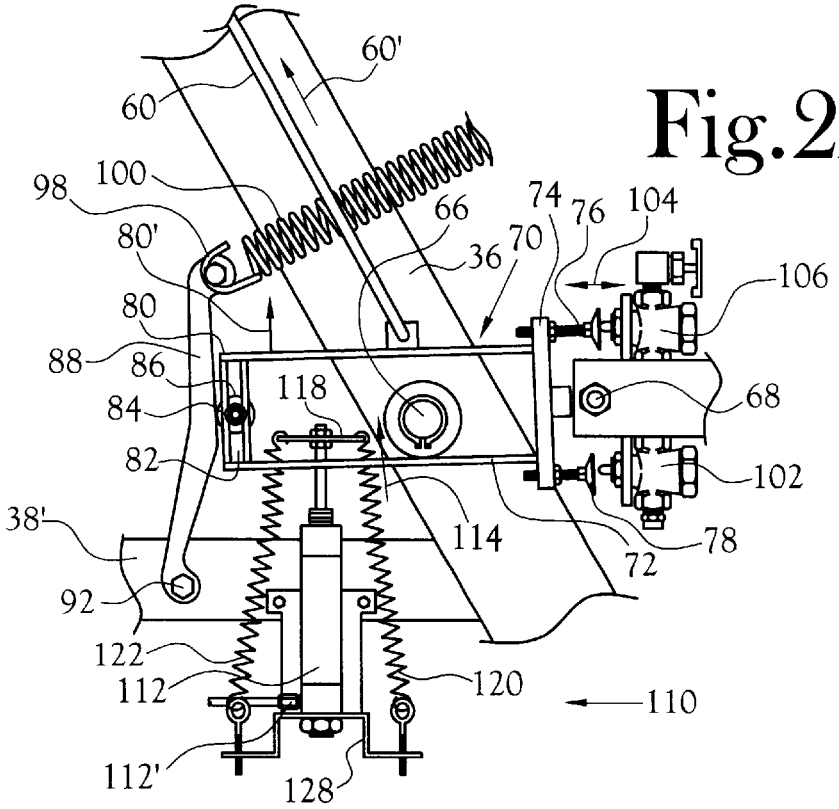
FIG. 2A is an exploded side view of FIG. 1, illustrating one embodiment of an activation device in a raised position and the deactivation device in a raised position when pneumatic fluid flow is applied to the garment finishing press.
Figure 2B:
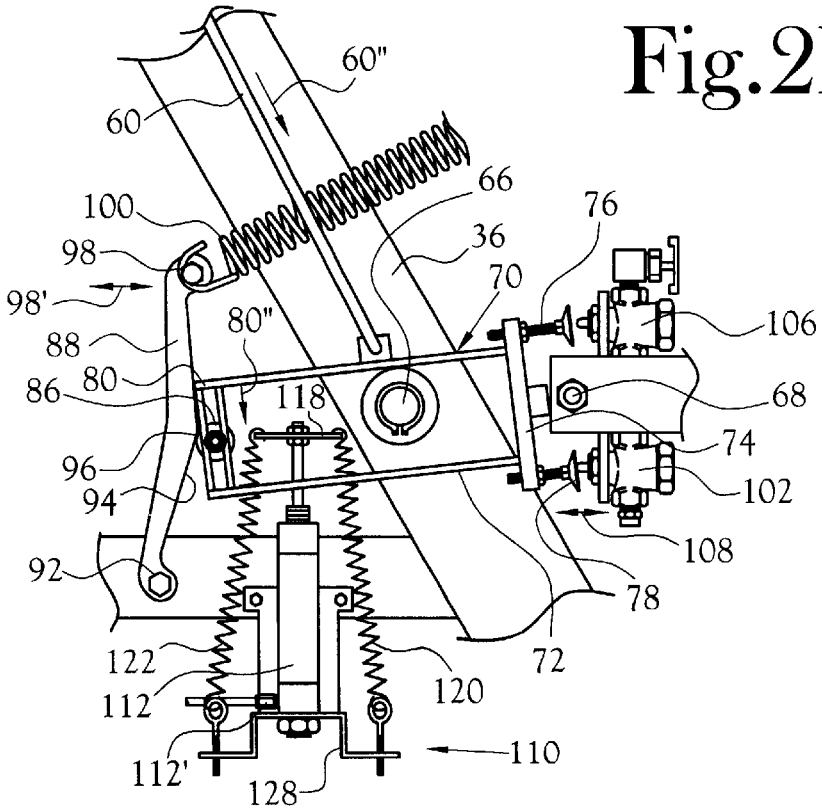
FIG. 2B is an exploded side view of FIG. 1, illustrating one embodiment of an activation device in a lower position and the deactivation device in a raised position when pneumatic fluid flow is applied to the garment finishing press.

During operation of the activation device 70, at least two independently actuator valves 102, 106 are activated to regulate the supply of pressurized air utilized to move the press head 20. A deactivation device 110 is positioned proximal to the frame 72 to control movement of the activation device 70 when pressurized air is interrupted to the garment finishing press 12. The deactivation device 110 includes means affixed to an extendable end, such as a flanged bracket 118 that is maintained in an extended position 114 (see FIGS. 2A and 2B) to minimize interference with the reciprocating motion of frame 72. The reciprocating motion of frame 72 results in repetitive reciprocation of valve actuators 76, 78 which reciprocatingly activate valves 102, 106 between operative and inoperative positions. Valves 102, 106 provide control of the flow of pressurized air supplied to at least one head closing piston and cylinder 34 which assists in the pneumatic movement up and down of pressure lever 22' and press head 20 in response to an operator's manipulation 42', 42" of the safety guard bar 42. As illustrated in FIG. 2A, when an operator manipulates the safety guard bar 42 downwards 42", connector rod 60 is moved up 60', reciprocating end 80 is moved up 80', with first end 74 pivoted about pivoting connection 68. When the upper portion of first end 74 pivots upwards, upper valve actuator 76 is moved laterally 104, and upper valve 106 is activated to transmit pressurized air to the head closing piston and cylinder 34 which assists in the pneumatic movement of pressure lever 22' and press head 20 for closing of the press head 20. As illustrated in FIG. 2B, when an operator manipulates the safety guard bar 42 upwards 42', the connector rod 60 is moved down 60" and connecting reciprocating end 80 is moved down 80", resulting in first end 74 pivoted downwards. Upon first end 74 pivoting downwards, lower valve actuator 78 is moved 108 towards lower valve 102, activating release of air pressure supplied to piston and cylinder 34, with raising of the press head 20.

Figure 2C:
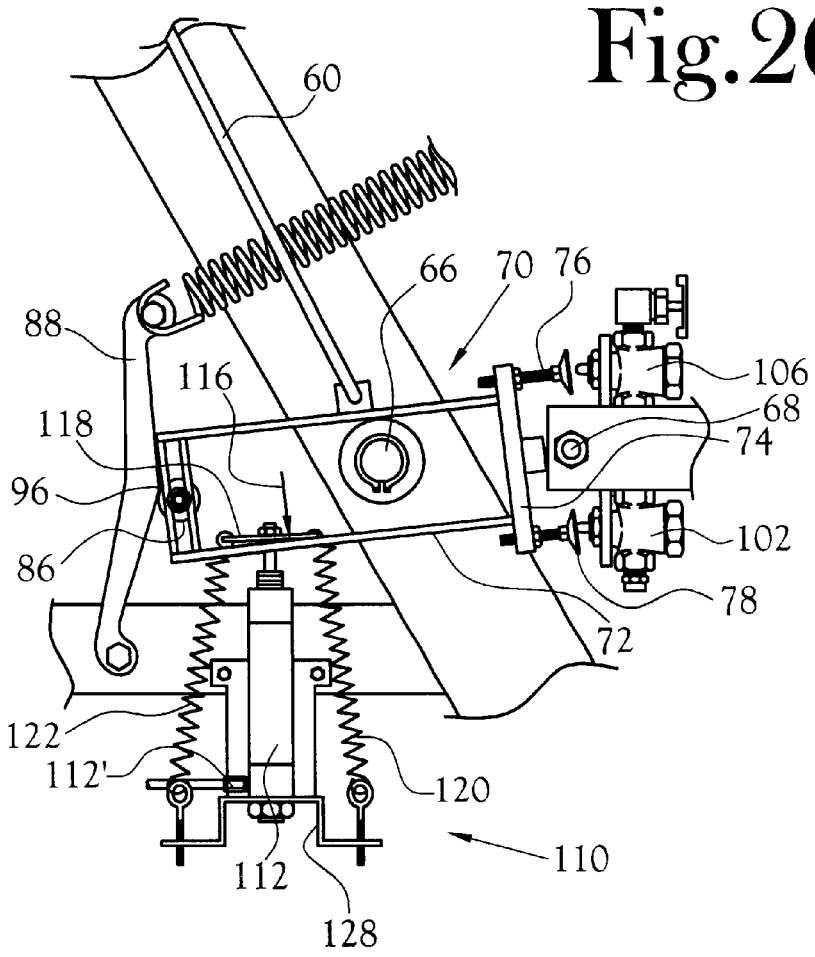
FIG. 2C is an exploded side view FIG. 1, illustrating one embodiment of an activation device maintained in a lower position by the deactivation device maintained in a lower position when pneumatic fluid flow is interrupted to the garment finishing press.
Figure 3:
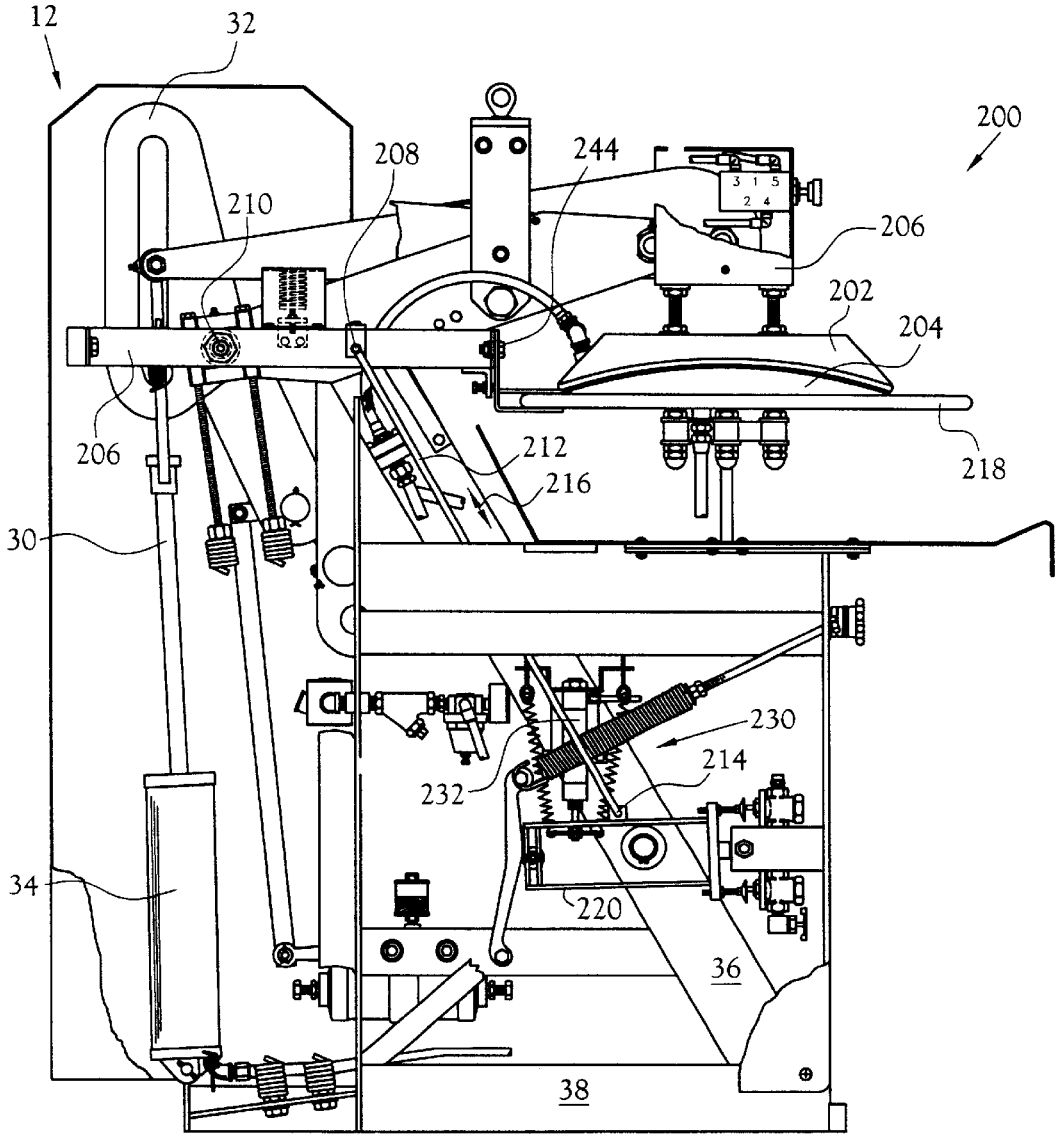
FIG. 3 is a side view of a garment finishing press including an alternative embodiment of an operator manipulated safety guard bar, connecting members, an activation device and an alternative embodiment of a deactivation device of the present invention.

The activation device 70 operates without interference from the deactivation device 110 illustrated in detail in FIGS. 2A and 2B, unless the supply of pressurized air is interrupted to the garment finishing press 12, at which time a piston means having a piston and cylinder 112 of the deactivation device 110 automatically actuates and moves to a retracted position 116 to restrain the movement of activation device 70 (see FIG. 2C). The deactivation device 110 provides a means for restraining movement of activation device 70, with resulting deactivation of the operation of valves 102, 106 during interruption of the supply of pressurized air to the garment finishing press 12, while maintaining the press head 20 and safety guard bar 42 in a fixed and open position during restraint of activation device 70. The press head 20 remains in a fixed and open position until pressurized air is resupplied to the garment finishing press 12, providing pressurized air to the piston valve connector 112', and to the piston and cylinder 112, which automatically extends flanged bracket 118 to an extended, operable position 114 (see FIG. 2A), therefore allowing reciprocating motion of frame 72, allowing the repetitive reciprocation of valve actuators 76, 78, which activates valves 102, 106 between operative and inoperative positions for transmission of pressurized air to the head closing piston and cylinder 34 which assists in the pneumatic movement of pressure lever 22' and press head 20 for closing of the press head 20.

The deactivation device 110 is positioned proximal to the activation device 70 (see FIG. 2A), to provide a safety measure for fail-safe control of the activation device 70 in order to protect an operator from closure of the press head 20 upon restart of the garment finishing press 12 or after temporary loss of pressurized air to the garment finishing press 12. As illustrated in FIG. 2A, the deactivation device 110 includes a piston means having a piston and cylinder 112 with a piston base end to which a piston valve connector 112' allows for a hose connection to provide connecting means to maintain the piston and cylinder 112 in fluid flow communication with the source of pressurized air providing pneumatic power to the garment finishing press 12. The piston and cylinder 112 includes an extendable piston rod having a distal end with a means affixed thereon for selective engagement of the activation device 70 when the extendable distal end is retracted 116 (see FIG. 2C). The extendable distal end includes a flanged bracket 118 that is disposed adjacent to, but is not connected to, a portion of a side of the frame 72. In the embodiment illustrated in FIGS. 2A and 2B, the flanged bracket 118 is positioned above the lower portion of the frame 72 when pressurized air is applied to the garment finishing process 12. While pressurized air is supplied to piston valve connector 112', the flanged bracket 118 and piston rod end of the piston and cylinder 112 remain extended 114. When the frame 72 is moved up or down, the flanged bracket 118 is not moved, and the flanged bracket 118 and piston rod end of the piston and cylinder 112 remain extended until air pressure is interrupted to the piston 112. The piston and cylinder 112 is attached at the cylinder base end to a stationary bracket 128 attached to at least one of the lower support members 38, 38'. The piston and cylinder 112 is positioned adjacent a spring means, including at least one spring 120, or a pair of springs 120, 122 that each have a first end attached to the flanged bracket 118, and each have a second end attached to the stationary bracket 128. The flanged bracket 118 remains in an extended position 114 while air pressure is supplied to the garment finishing press 12 and to the piston and cylinder 112 by piston valve connector 112', as long as the air pressure exceeds the force of recoil of the springs 120, 122. When air pressure is interrupted to the piston and cylinder 112, the flanged bracket 118 and respective piston rod end of the piston and cylinder 112 are moved to a retracted position 116 (see FIG. 2C) by the recoil force of springs 120, 122. Flanged bracket 118 remains in a retracted position 116 due to the tension provided by springs 120, 122, as long as air pressure is interrupted to piston valve connector 112', with resulting restraint on movement of frame 72 of activation device 70 which restrains movement of connector rod 60, and which restrains the reciprocation of valves 102, 106. Upon resupply of air pressure to piston valve connector 112', the air pressure is typically greater than the recoil force of springs 120, 122, allowing flanged bracket 118 and piston rod end to extend to an extended position 114 from the piston and cylinder 112, thereby allowing movement of the frame 72 of activation device 70. During the interruption of air pressure to garment finishing press 12 and piston valve connector 112', restraint in movement of frame 72 is imposed by flanged bracket 118 (see FIG. 2C), which maintains safety guard bar 42 in a fixed, upright position until pressurized air is resupplied to garment finishing press 12 and piston valve connector 112'. Upon resupply of pressurized air to piston valve connector 112' and piston and cylinder 112, the flanged bracket 118 automatically resets to an extended position 114 (see FIG. 2A), for resumption of the reciprocating movement of frame 72 of the activation device 70.

An alternative embodiment of a safety guard system 200 is illustrated in FIGS. 3 and 4A–4C. The alternative embodiment includes a deactivation device 230 positioned above and adjacent to an activation frame device 220. A safety guard bar 218 and a press head 202 and are manipulated between operative (see FIG. 3) and inoperative (open) positions in relation to pressing buck 204. Movement of lever arm 22, pressure lever 22', press head support 22" and press head 202 into the operative position occurs after pressurized air is transmitted to head closing piston and cylinder 34 which extends piston rod 30 for movement of pressure lever 22' and closure of the press head 202. Pressurized air is transmitted to head closing piston and cylinder 34 upon a sequence of events initiated by downwards movement of guard bar 218, which triggers a sequence of movements including movement of safety guard bar support member 206 at the pivoting connections 208, 210, and movement 216 of connector rod 212 with reciprocation of an activation device having a frame 220. Reciprocation of frame 220 provides activation of the upper air valve 226 and lower air valve 228 between operative and inoperative positions, thereby allowing pressurized air to extend the piston rod 30 attached to head closing piston and cylinder 34, with movement of pressure lever 22' and closure of the press head 202. (see FIG. 3). In the alternative embodiment, when safety guard bar 218 is moved downwards by an operator, with resulting movement of the press head 202 to an operative position, rotation occurs at first pivot 208 and the connector rod 212 is moved 216 downwardly, and rotation occurs at connector pivot 214 resulting in movement of frame 220 downwards 222 (see FIG. 4A). Downwards movement of frame 220 provides activation of the lower air valve 228 to an operative or head closure position, thereby allowing pressurized air to extend the piston rod 30 attached to head closing piston and cylinder 34, to force closure of press head 202. A flanged bracket 238 remains extended from the piston and cylinder 232 of the deactivation device 230 to a downwardly position 234 (see FIGS. 4A and 4B), when pressurized air is supplied to garment finishing press 12. When safety guard bar 218 and press head 202 are moved upwards by an operator, rotation occurs at first pivot 208, which moves connector rod 212 upwards at connector pivot 214, resulting in movement of frame 220 upwards 224 (see FIG. 4B), and activation of the upper air valve 226 to an operative or head opening position, thereby allowing the piston rod 30 to retract into head closing piston and cylinder 34, to raise the press head 202 to an inoperative position. Flanged bracket 238 remains in a downwardly position while pneumatic fluid flow is maintained to a piston valve connector 232' attached to the piston and cylinder 232. With continuous reciprocation of frame 220 in response to an operator's movement of guard bar 218, the upper air valve 226 and lower air valve 228 are moved between operative and inoperative positions, to either allow for movement downwards of the press head 202 in operative position against press buck 204 (see FIG. 3), or to move press head 202 into an upwards, open and inoperative position.

Figure 4A:
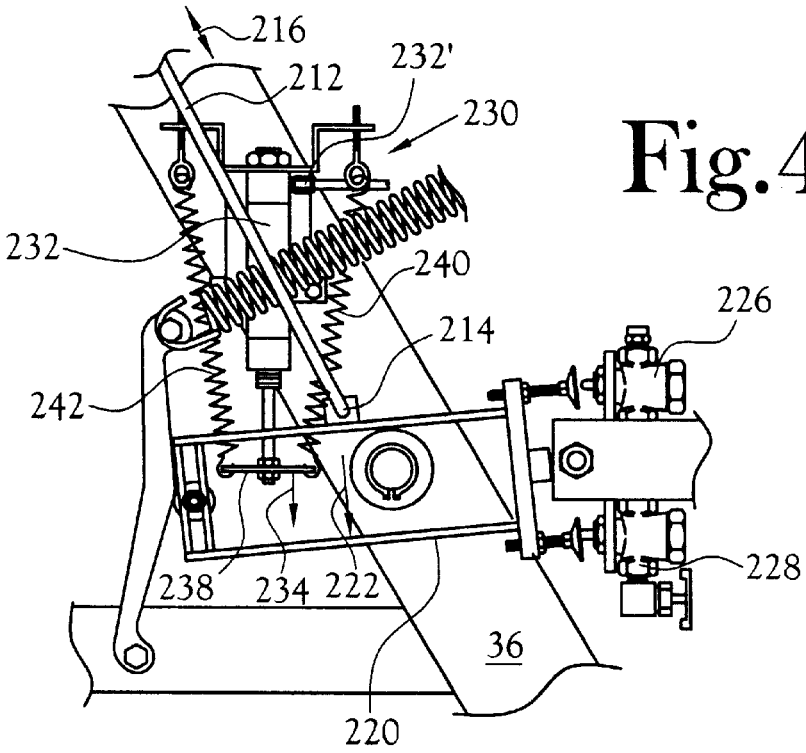
FIG. 4A is an exploded side view of FIG. 3, illustrating an alternative embodiment of an activation device in a lower position and the deactivation device in a lower position when pneumatic fluid flow is applied to the garment finishing press.
Figure 4B:
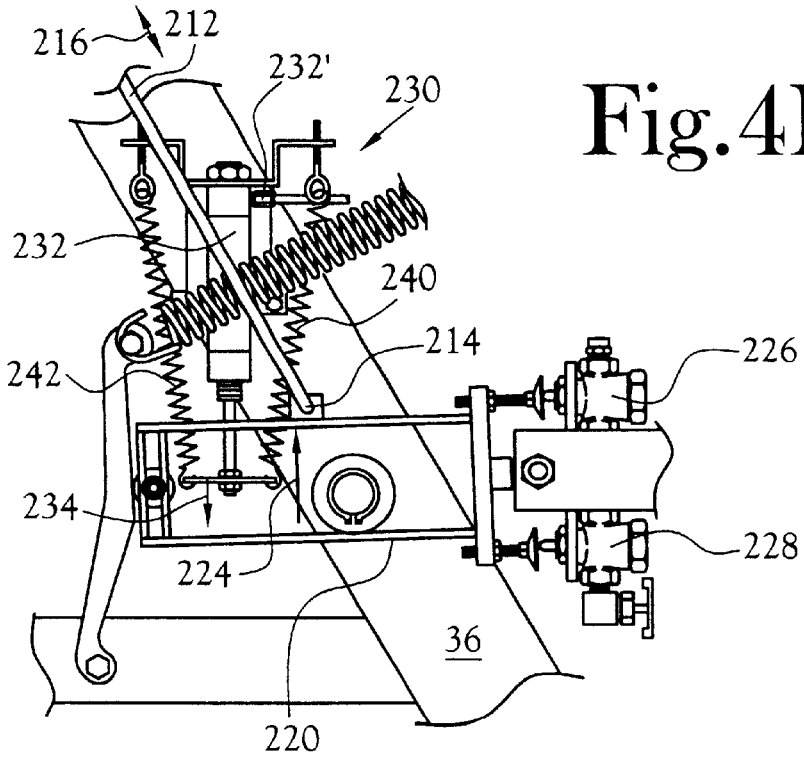
FIG. 4B is an exploded side view of FIG. 3, illustrating an alternative embodiment of an activation device in a raised position and the deactivation device in a lower position when pneumatic fluid flow is applied to the garment finishing press.
Figure 4C:
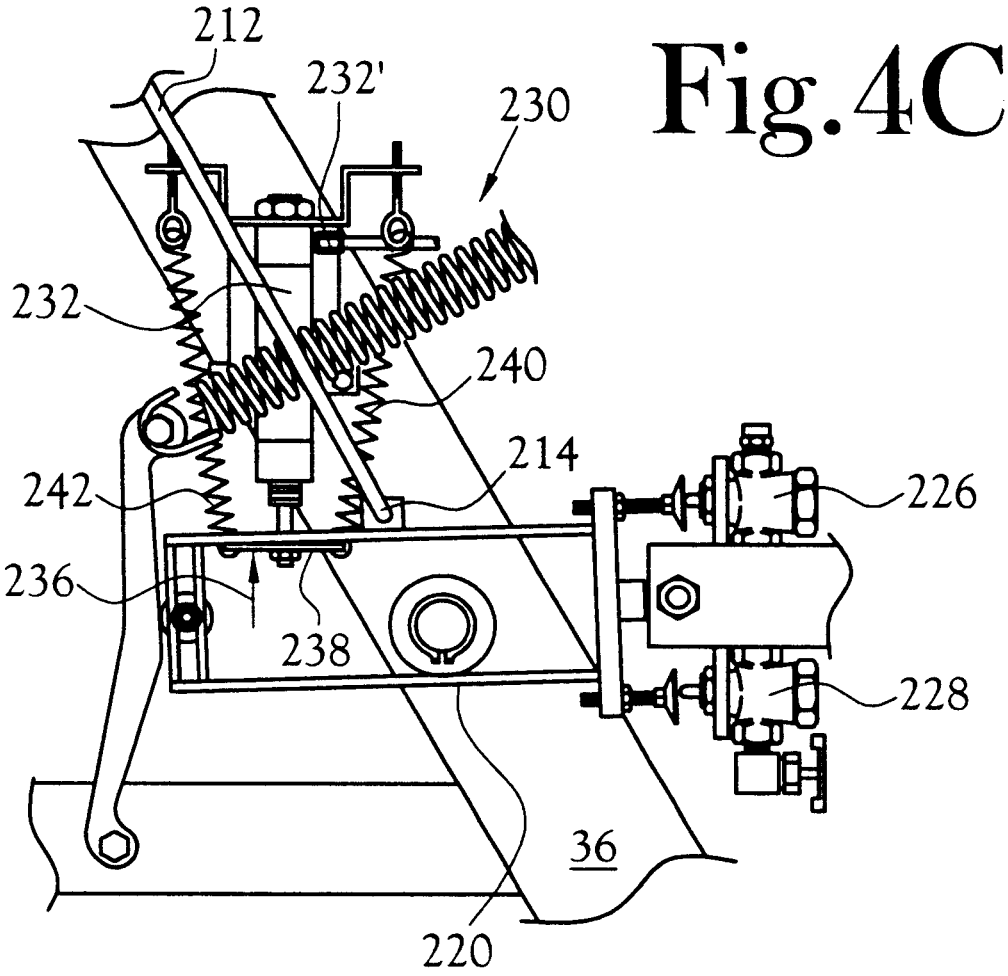
FIG. 4C is an exploded side view of FIG. 3, illustrating an alternative embodiment of an activation device maintained in a raised position by the deactivation device maintained in a raised position when pneumatic fluid flow is interrupted to the garment finishing press.

When pressurized air is interrupted to the deactivation device 230, and garment finishing press 12, the loss of pressurized air to piston and cylinder 232 as transmitted through piston valve connector 232', allows at least one spring of spring means, and preferably two springs 240, 242 to raise the flanged end 238, therefore moving frame 220 to a raised, retracted position 236 (see FIG. 4C). Until pressurized air is resupplied to the garment finishing press 12, to deactivation device 230, and to piston valve connector 232', the flanged end 238 is maintained in a raised, retracted position 236 with resulting restraint on movement imposed on frame 220 and connector rod 212, and restraint on the reciprocation of valves 226, 228 with a resulting restraint on the transmission of pressurized air to head closing piston and cylinder 34. Therefore, the press head 202 and safety guard bar 218 are maintained in an upright, open position upon interruption of pressurized air to the garment finishing press 12. The flanged end 238 of deactivation device 230 is returned to an extended, downwardly position 234 (see FIG. 4A), upon resupply of pressurized air to the piston valve connector 232' of the deactivation device 230 positioned on a garment finishing press 12. With the flanged end 238 in the extended, downwardly position 234, the activation device frame 220 is free to reciprocate upon the manipulation by the operator of the safety guard bar 218.

A method of operation of the safety guard system 10 includes a plurality of steps for operation of a deactivation system for controlling movement of a press head 20 of a garment finishing press 12 activated by pressurized air. The method includes a step of manipulating a guard bar 42 attached proximal to the press head 20 of the garment finishing press 12. The manipulating step repositions the guard bar 42 towards a downwardly, operative position, and triggers a plurality of movements of interconnected connecting means with resulting movement of an activation device 70 for reciprocation of activation valves 102, 106. At least one of the valves 102, 106 allow for transfer of pneumatic air to an appropriately positioned head closing piston and cylinder 34 and piston rod 30 for movement of the press head 20 between a raised, inoperative position to a lowered, operative position against the pressing buck 18 in response to manipulating the guard bar 42 (see FIG. 1). A step of reciprocating includes pivoting a connecting means having a connector 54 positioned between a plurality of pivot points 50, 52 that are rotated as the manipulating step repositions the guard bar 42 and press head 20. The step of reciprocating further includes moving a connector member 60 attached to the pivoting connecting means, for reciprocating an activation device 70 having frame 72 disposed to activate valve means 102, 106 for control of flow of pressurized air supplied to move the press head 20. The step of reciprocating includes reciprocating frame 72 from the first, upwards position (see FIG. 2A), to a second, downwards position (see FIG. 2B). Concurrent with the step of reciprocating and upon continued providing of pressurized air to the garment finishing press 12, a step of actuating occurs for a deactivation device 110 that includes extending a flanged bracket 118 attached to piston and cylinder 112 to a first, extended position away from the reciprocating frame 72. The flanged bracket 118 is maintain in an extended, operable position 114 while pressurized air is supplied to the garment finishing press 12. When pressurized air is interrupted to the press 12 and the piston 112, a step of actuating occurs with the spring means 120, 122 displacing flanged bracket 118 attached to piston 112 to a retracted position against frame 72 (see FIG. 2C), halting of movement of frame 72 and returning the press head 20 into an inoperative position. A step of resetting includes re-supplying pressurized air to the garment finishing press 12 and to piston and cylinder 112 of deactivation device 110, with resulting extension of flanged bracket 118 away from frame 72. The step of resetting further includes allowing reciprocating movement of frame 72, allowing activating of at least one valve 102, 106, and transmitting of pressurized air to the garment finishing press 12, for movement of the press head 20 upon re-manipulating of the guard bar 42 by an operator. The method of operation of the deactivation system protects an operator from closure of a press head 20 onto the operator's hands and arms after interruption and resupply of pressurized air to a garment finishing press 12.

While numerous embodiments have been shown and described, it will be understood that it is not intended to limit the disclosure of the invention to the specific details of the apparatus and method of operation shown and described herein, but rather it is intended to cover all modifications to the apparatus and alternate methods of operation falling within the spirit and the scope of the invention as defined in the appended claims.

Having thus described the aforementioned invention, we claim:

1. A safety guard system for control of operation of a press powered by pressurized air transmitted to operate at least one piston and cylinder for movement of a press head between operative and inoperative positions, the transmitted pressurized air is controlled by an independently actuatable valve, comprising:

a guard bar connected in pivoting relationship with the press head, said guard bar is manipulated by an operator to actuate an independently actuatable valve for movement of the press head between operative and inoperative positions;

an operator responsive mechanism responsive to the movement of said guard bar and the press head between its operative and inoperative positions, said operator responsive mechanism interposed between the press head and the independently actuatable valve; and a deactivation device positioned proximal to the independently actuatable valve, said deactivation device includes a piston and a piston rod having a bracket means affixed to an extendable end of said piston rod that is movable between an extended position and a retracted position, said bracket means affixed to said extendable end is maintained in said extended position while pressurized air is supplied to the press, said bracket means affixed to said extendable end is moved to said retracted position when pressurized air is interrupted to the press;

whereby actuation of the independently actuatable valve is restrained by said bracket means in said retracted position upon interruption of pressurized air to the press with the guard bar maintained in the inoperative position until pressurized air is resupplied to the press and said guard bar is manipulated by an operator.

2. The safety guard system of claim 1 wherein said operator responsive mechanism includes:

a connector member disposed between a first pivot and a second pivot, said connector member is pivoted in unison with said guard bar being manipulated between said operative position and said inoperative position of the press head; and an activation device connectable by a connecting means to said connector member at said second pivot, said activation device is reciprocated between a raised position and a lowered position by said connecting means when said guard bar is manipulated, said activation device controls the movement of the independently actuatable valve between open and closed positions thereby allowing passage of pressurized air for movement by at least one piston and cylinder of the press head between operative and inoperative positions.

3. The safety guard system of claim 2, said deactivation device including said piston having a piston base end fixed proximal to said activation device, said bracket means affixed to said extendable end having a flanged bracket attached thereto, said flanged bracket disposed to contact said activation device when in said retracted position, said flanged bracket and said extendable end is moved to said extended position when pressurized air is supplied to the press, said flanged bracket and said extendable end remains in said extended position while pressurized air is supplied to the press.

4. The safety guard system of claim 3 wherein said deactivation device further includes:

a spring means positioned proximal to and substantially adjacent to said piston, said spring means having a first end mounted to a first structural member of the press proximal to said piston base end, said spring means having a second end connected to said flanged bracket on opposed sides of said piston, said spring means being extended when said flanged bracket of said extendable end are extended to said extended position by the supply of pressurized air to the press; and a piston valve connector removably attached to said piston, said piston valve connector in fluid communication with the pressurized air provided to the press to provide pressurized air to said piston while pressurized air is activated to the press;

said spring means recoils to move said flanged bracket to said retracted position when the supply of pressurized air is interrupted to said piston valve connector attached to said piston, said flanged bracket in said retracted position restrains said activation device from reciprocating until pressurized air is resupplied to said press and said piston valve connector, said piston rod is extended from said piston to extend said flanged bracket to said extended position upon resupply of pressurized air to said press and said piston valve connector.

5. The safety guard system of claim 4 wherein said activation device includes:

a frame having a first end that is reciprocated about a pivot attached at said first end to a second structural member of the press, said frame having at least one side disposed proximal to said flanged bracket, said frame having a second end disposed to enclosed said deactivation device between said first end and said second end;

said at least one actuatable valve including a first and a second pressure control valve positioned proximate to respective corners of said first end of said activation device, said first and said second pressure control valve being actuated between respective open and closed configurations as said frame is reciprocated, said first and said second pressure control valves are in pneumatic communication with the pressurized air system of the press; and a stop member being positioned within said frame, said stop member restricts the reciprocated motion of said frame between said raised position and said lowered position of said activation device.

6. In a press powered by a source of pneumatic power and having a press head wherein the operation of the press head between operative and inoperative positions is controlled by at least one independently actuatable valve in communication with a source of pneumatic power, the improvement comprising:

an operator responsive mechanism responsive to the movement of the press head between its operative and inoperative positions and interposed between the press head and the independently actuatable valves;

a deactivation device including a piston having a stationary end fixedly anchored relative to a structural member of the press and having a piston rod reciprocatingly extended and retracted from said piston and having a distal end thereof projecting outwardly of said piston rod;

a bracket means affixed to said distal end of said piston rod for selective engagement with said operator responsive mechanism as a function of the extension or retraction of said piston rod within said piston; and a piston connecting means in fluid flow communication with the source of pneumatic power, said piston connecting means attached to said piston of said deactivation device whereupon the continued communication of pneumatic power to said piston effects non-engagement with said operator responsive mechanism of said bracket means affixed to said distal end of said piston rod, and cessation of communication of pneumatic power to said piston effects engagement of said bracket means affixed to said distal end of said piston rod with said operator responsive mechanism and consequential actuation of one or more of the independently actuatable valves to position the press head and said guard bar to its inoperative position.

7. The improvement of claim 6 wherein said piston rod is biased toward its retracted position within said piston upon cessation of communication of pneumatic power to said piston.

8. The improvement of claim 7 and including spring means having first and second opposite ends, said first end of spring means being anchored to a structural member of the press and said second end of said spring means being anchored to said bracket means affixed to said distal end of said piston rod, said spring means returns said piston rod to its retracted position within said piston upon cessation of communication of pneumatic power to said piston.

9. The improvement of claim 8 wherein said bracket means affixed to said distal end of said piston rod includes a flanged bracket disposed proximal to said bracket means, said flanged bracket engages said operator responsive mechanism upon cessation of communication of pneumatic power to said piston, said spring means returns said flanged bracket to its retracted position with consequential actuation of said independently actuatable valves to position the press head and said guard bar to its inoperative position until resupply of pneumatic power to said bracket means connected to said piston.

10. The improvement of claim 9 wherein said operator responsive mechanism includes a guard bar manipulated by an operator between operative and inoperative positions, said guard bar is connectable by a connecting means to an activation device disposed to reciprocate said independently actuatable valves between operative and inoperative positions with responsive movement of the press head between operative and inoperative positions.

11. The improvement of claim 10 wherein said activation device disposed to reciprocate said independently actuatable valves includes:

a frame member that is reciprocated about a pivot end upon operation of the guard bar between operative and inoperative positions; and a first and a second pressure control valve positioned proximate to respective corners of said pivot end of said activation device, said first and said second pressure control valve being actuated between operative and inoperative positions for control of pressurized air provided by the source of pneumatic power, said first and said second pressure control valve operate to move the press head as said frame member is reciprocated, said first and second pressure control valves are in pneumatic communication with the source of pneumatic power of the press.

12. A deactivation device for control of movement of a press head by a piston means of a garment finishing press powered by a source of pneumatic power wherein the operation of the press head between operative and inoperative positions is controlled by at least one independently actuatable valve responsive to movement by an operator of a guard bar connected to the press head, said deactivation device is activated upon interruption of pneumatic fluid flow to the garment finishing press, comprising:

an activation device in pneumatic fluid flow communication with the source of pneumatic power, said activation device responsive to movement of the guard bar by a connecting means interposed to connect between the guard bar and the activation device, said activation device is reciprocated between a first position and a second position by said connecting means for control of pneumatic fluid flow to the press head piston means for movement of the press head when the guard bar is manipulated by the operator; and a deactivation device including a piston and cylinder having a base end fixedly anchored to a structural member of the press and proximal to said activation device, said piston and cylinder including a piston rod having an extendable end from said piston and cylinder, a flanged bracket attached to said extendable end, said flanged bracket disposed to contact said activation device when said piston rod is moved to a retracted position upon interruption of pneumatic fluid flow to the press, whereby the press head and the guard bar is maintained in the inoperative position during interruption of pneumatic fluid flow to the press, said flanged bracket and said extendable end of said piston and cylinder being moved to an extended position when pressurized air is re-supplied to the press, said flanged bracket and said extendable end of said piston and cylinder remain in said extended position until fluid flow communication is interrupted between the source of pneumatic power and the press.

13. The deactivation device of claim 12, wherein said deactivation device includes:

a spring means positioned substantially adjacent to said piston and cylinder, said spring means having a first end mounted to said piston and cylinder base end, said spring means having a second end connected to said flanged bracket attached to said extendable end, said spring means being extended when said flanged bracket is extended to said extended position; and a piston valve connector attachable to said piston and cylinder, said piston valve connector in communication with the pneumatic fluid flow of the source of pneumatic power, said piston valve connector allows pneumatic fluid flow to said piston valve connector and said piston and cylinder;

said spring means recoils to move said flanged bracket to said retracted position when the pneumatic fluid flow is interrupted to said piston valve connector and said piston and cylinder, whereby said flanged bracket in said retracted position restrains said activation device from reciprocating until pneumatic fluid flow is restored to the press, said flanged bracket is automatically reset to said extended position after pneumatic fluid flow is restored to said piston valve connector, said piston and cylinder, and the garment finishing press.

14. The deactivation device of claim 13 wherein said activation device includes:

a frame member positioned to reciprocate said at least one independently actuatable valve, said frame member having at least one side disposed to be contacted by said flanged bracket, said frame member is limited from reciprocation by said flanged bracket in said retracted position;

said at least one independently actuatable valve including a first and a second actuator valve positioned proximate to said frame member, said first and second actuator valves being actuated between respective open and closed configurations as said frame member is reciprocated, said first and second actuatable valves regulate transfer of pneumatic fluid flow from the source of pneumatic power to the piston means for movement of the press head;

whereby when said frame member is limited from reciprocation by said flanged bracket in said retracted position, said at least one independently actuatable valve is restrained from reciprocation and transfer of pneumatic fluid flow is restricted to the piston means with the press head and the guard bar maintained in the inoperative position.

15. A method of operation of a deactivation system for controlling movement of a press head in relation to a pressing surface of a garment press activated by pneumatic fluid flow provided by a source of pneumatic power, comprising the steps of:

manipulating a guard bar encircling the press head, said manipulating step positioning said guard bar and the press head between an operative position and an inoperative position;

reciprocating an activation system in pneumatic communication with the source of pneumatic power, said step of reciprocating linking the movement of said activation system to an activating position with the movement of said guard bar between said operative position and said inoperative position;

actuating a deactivation device to an extended position when pneumatic power is provided to the garment press, said deactivation device is in pneumatic fluid flow communication with the source of pneumatic power, said deactivation device is maintained in said extended position while the garment press is supplied with pneumatic fluid flow from the source of pneumatic power; and repositioning said deactivation device to a retracted position for limiting movement of said activation system upon interruption of pneumatic fluid flow to said deactivation device and the garment press, said step of repositioning limits movement of said activation system by maintaining said deactivation device in said deactivating position for limiting movement of said activation system during interruption of pneumatic fluid flow to the garment press.

16. The method of claim 15 further comprises the steps of:

resetting said deactivation device to said extended position, said step of resetting includes resupplying pneumatic fluid flow from the source of pneumatic power to the garment press when pneumatic fluid flow is restored to the garment press, said deactivation device automatically extending upon resupplying pneumatic fluid flow to the garment press, said step of resetting allows said step of manipulating to proceed when pneumatic fluid flow is provided to said deactivation device and the garment press.

* * * * *